US005223655A

United States Patent [19]

Watanabe et al.

[11] Patent Number: 5,223,655

[45] Date of Patent: Jun. 29, 1993

[54] ELECTRONIC MUSICAL INSTRUMENT GENERATING CHORD DATA IN RESPONSE TO REPEATED OPERATION OF PADS

[75] Inventors: Kunihiko Watanabe; Shinichi Ito; Yoshinori Iwakami, all of Hamamatsu, Japan

[73] Assignee: Yamaha Corporation, Hamamatsu, Japan

[21] Appl. No.: 673,149

[22] Filed: Mar. 20, 1991

[30] Foreign Application Priority Data

Mar. 20, 1990 [JP] Japan ..... 2-70726

[51] Int. Cl.[5] ..... G10H 7/00; G10H 1/38

[52] U.S. Cl. ..... 84/637; 84/735; 84/669; 84/DIG. 12; 84/DIG. 22

[58] Field of Search ..... 84/735, 644, 601, 602, 84/610, 613, 634, 637, 650, 666, 669, 670, 743, DIG. 22, 715, DIG. 12

[56] References Cited

U.S. PATENT DOCUMENTS 4,295,402 10/1981 Deutsch et al. ..... 84/715
4,353,278 10/1982 Adachi .
4,365,532 12/1982 Nakada et al. ..... 84/615
4,499,807 2/1985 Ishida ..... 84/DIG. 22
4,867,028 9/1989 Jones ..... 84/735
4,932,303 6/1990 Kimpara ..... 84/DIG. 12 X
4,939,974 7/1990 Ishida et al. ..... 84/609
5,001,959 3/1991 Kimpara ..... 84/615 X
5,099,738 3/1992 Hotz ..... 84/617

*Primary Examiner*—William M. Shoop, Jr.
*Assistant Examiner*—Jeffrey W. Donels
*Attorney, Agent, or Firm*—Spensley, Horn, Jubas & Lubitz

[57] ABSTRACT

An electronic musical instrument with pads is provided with a plurality of pads, a pad operation detection device, and a chord data generation device which generates specified chord data corresponding to a pad when the pad has been operated a second time within a specified time. Since chord data previously corresponds to each pad, if a player operates a pad two times within the specified time, chord data corresponding to that pad is generated. This chord data is provided to an accompaniment playing device and accompaniment playing is performed.

11 Claims, 11 Drawing Sheets

Percussion Sets

| | | P1 | P2 | P3 | P4 | P5 | P6 | P7 | P8 | Foot pedal |
|---|---|---|---|---|---|---|---|---|---|---|
| Drum Tones | Rock drums | Synthesizer snare | Snare | Tom tom 1 | Tom tom 2 | Closed high-hat | Open high-hat | Cymbal 1 | Cymbal 2 | Bass drum |
| | Jazz drums | Brushes | Snare | Tom tom 1 | Tom tom 2 | Closed high-hat | Tom tom 3 | Cymbal 1 | Cymbal 2 | Bass drum |
| | Synthesizer drums | Synthesizer snare | Snare | Synthesizer Tom tom 1 | Synthesizer Tom tom 2 | Closed high-hat | Synthesizer Tom tom 3 | Cymbal 1 | Cymbal 2 | Bass drum |
| Scale Tones | Timpani | C1 | E1 | G1 | B1 | D1 | E1 | A1 | C2 | # |
| | Marimba | C3 | E3 | G3 | B3 | D3 | F3 | A3 | C4 | # |
| | Vibraphone | C3 | E3 | G3 | B3 | D3 | F3 | A3 | C4 | # |
| Auto Bass Chord(ABC) | | C/Maj | E/M7 | G/7 | B/7S[4] | D/min | F/m7 | A/m[7-5] | C/dim | # |
| ⋮ | | ⋮ | ⋮ | ⋮ | ⋮ | ⋮ | ⋮ | ⋮ | ⋮ | ⋮ |

Percussion Sets

| | | P1 | P2 | P3 | P4 | P5 | P6 | P7 | P8 | Foot pedal |
|---|---|---|---|---|---|---|---|---|---|---|
| Drum Tones | Rock drums | Synthesizer snare | Snare | Tom tom 1 | Tom tom 2 | Closed high-hat | Open high-hat | Cymbal 1 | Cymbal 2 | Bass drum |
| | Jazz drums | Brushes | Snare | Tom tom 1 | Tom tom 2 | Closed high-hat | Tom tom 3 | Cymbal 1 | Cymbal 2 | Bass drum |
| | Synthesizer drums | Synthesizer snare | Snare | Synthesizer Tom tom 1 | Synthesizer Tom tom 2 | Closed high-hat | Synthesizer Tom tom 3 | Cymbal 1 | Cymbal 2 | Bass drum |
| Scale Tones | Timpani | C1 | E1 | G1 | B1 | D1 | E1 | A1 | C2 | # |
| | Marimba | C3 | E3 | G3 | B3 | D3 | F3 | A3 | C4 | # |
| | Vibraphone | C3 | E3 | G3 | B3 | D3 | F3 | A3 | C4 | # |
| Auto Bass Chord(ABC) | | C/Maj | E/M7 | G/7 | B/7S$^{4}$ | D/min | F/m7 | A/m$^{7-5}$ | C/dim | # |
| ⋮ | | ⋮ | ⋮ | ⋮ | ⋮ | ⋮ | ⋮ | ⋮ | ⋮ | ⋮ |

Fig.3

Registers

| | | | |
|---|---|---|---|
| STYLE | Style no. register | ROOT 1 | Root register 1 |
| TONE | Pad tone color register | ROOT 2 | Root register 2 |
| PED | Pedal tone color register | ROOT 3 | Root register 3 |
| PADTCH | Pad touch register | ROOT 4 | Root register 4 |
| PEDTCH | Pedal touch register | SECOND | Second ON flag |
| TYPE1 | Type register 1 | PEDF | Pedal flag |
| TYPE2 | Type register 2 | PEDON | Pedal ON flag |
| TYPE3 | Type register 3 | ABC | Auto bass chord |
| | | i | Pad no. register |

Fig.5

ELECTRONIC MUSICAL INSTRUMENT GENERATING CHORD DATA IN RESPONSE TO REPEATED OPERATION OF PADS

BACKGROUND OF THE INVENTION

1. Field of the Invention

This invention relates to an electronic musical instrument provided with pads, in particular, a percussion type electronic instrument.

2. Description of the Prior Art

The electronic percussion instrument is provided with a plurality of pads, a detecting means for detecting when a pad is struck (pad ON), and a generating means for generating musical tone control signals including the tone color and pitch corresponding to each pad. In prior art electronic percussion instruments configured in this way, playing is executed once a tone color, etc. has been assigned to each pad.

In electronic musical instruments not provided with pads, for example, an electronic musical keyboard instrument, a keyboard for accompaniment playing, etc. has been previously assigned and chord sounds can be generated using this keyboard. There are also electronic musical instruments capable, by various methods, of specifying the type of chords generated when keys are depressed. For example, the electronic musical instrument disclosed in Japanese Patent Publication No. 62-8799 (Japanese Patent Laid-Open No. sho 56-43699) generates specified chord data in which the chord type is determined based on the relationship between the first and second key depressions in a keyboard with accompaniment playing or in an accompaniment playing key range.

The above means for generating chord data, however, is presently installed only in electronic musical keyboard instruments and electronic wind instruments. Therefore, electronic percussion instruments provided with pads could only generate playing data for previously set tone colors and pitches.

SUMMARY OF THE INVENTION

The first object of the present invention is to provide an electronic musical instrument which can generate chord data by using pad ON signals.

The second object of the present invention is to provide an electronic musical instrument which can change the above-mentioned chord data based on the difference in the ON times of the same pad.

The present invention comprises a plurality of pads; a detecting means for detecting the operation of each pad; a measuring means for measuring the time intervals of the pad operations based on the detection output of the measuring means; and a chord data generating means for generating specified chord data corresponding to pads whose operations have been detected by the detecting means if the measured value of the measuring means is within the specified time; thereby, accompaniment playing according to said chord data is performed.

Furthermore, the chord data generating means is capable of generating the chord data including previously determined specified chord type data, if the measured value of the measuring means exceeds the specified time.

In the above configuration, the timer is activated as soon as a pad turns ON (is struck), and the time until that pad is turned ON a second time is measured. If that time is within the specified time, the chord data corresponding to that pad is read from a memory and generated.

If the time between the first and second times said pad turns ON exceeds said specified time, chord type data is generated. Root tone data in this case, for example, data corresponding to the pad turned ON the first time, will be selected.

BRIEF DESCRIPTION OF THE DRAWINGS

FIG. 3 shows tone colors, etc. assigned to each pad corresponding to the percussion set names.

FIG. 5 shows data registers.

DETAILED DESCRIPTION OF THE PREFERRED EMBODIMENTS

Figure 1:
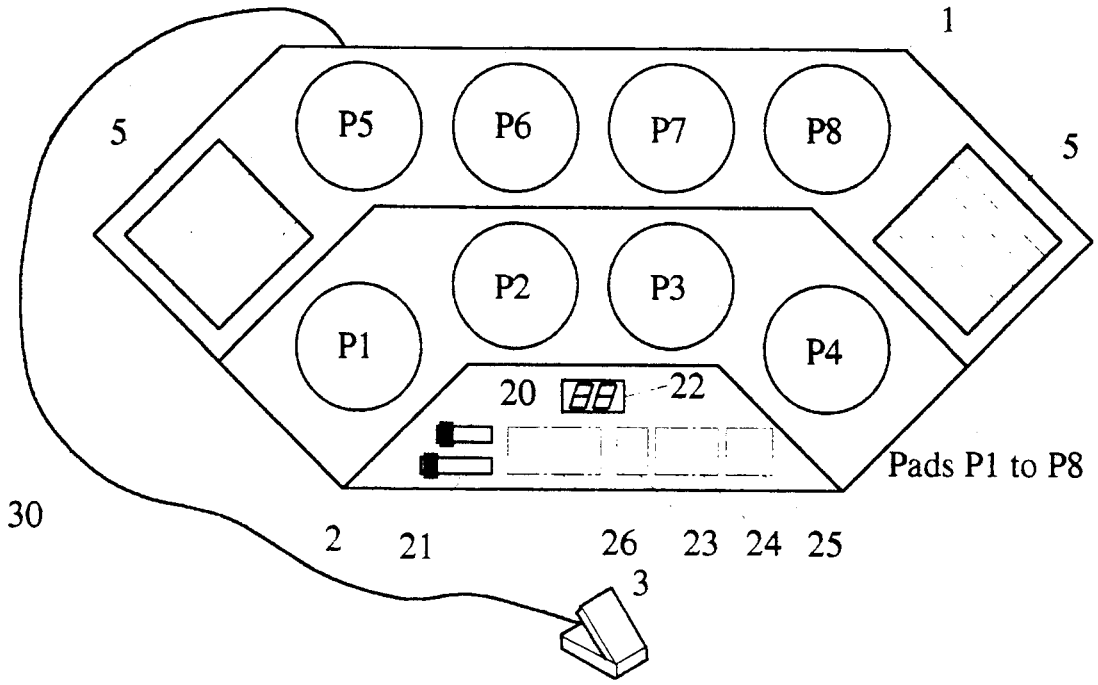
FIG. 1 shows a top view of the electronic percussion instrument of an embodiment according to the present invention.

FIG. 1 is a top view of the electronic percussion instrument of an embodiment according to the present invention.

An operation panel 2 is located at the front of the instrument body 1. This operation panel 2 is provided with the following: a power supply switch 20, a volume control 21 to adjust volume output from speakers, two rows of LCD indicators 22, a percussion set switch 23 to set a percussion set name, such as a tone color of each pad, the scales of all the pads, or an auto bass chord mode (ABC mode), a style switch 24 to set chord sound generation patterns, a ten-key 25 to input numerical values, and a functions switch 26 for additional functions.

A foot pedal 3 is connected to the electronic percussion instrument body 1 by a cable 30. When the foot pedal is operated (depressed) by a player, this foot pedal 3 generates a tone of the specified tone color of a bass drum, etc., according to the percussion set name set by the percussion set switch 23 and raises the tones of ON pads and of the ABC (auto bass chord) by a halftone.

Figure 2:
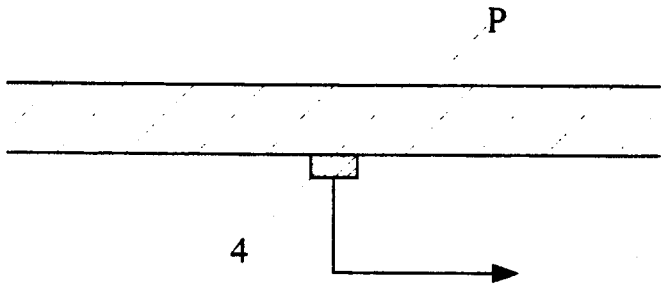
FIG. 2 shows a sectional view of a certain portion of a pad.

A total of 8 pads, P1 to P8, are installed in the center of the electronic percussion instrument body 1. A piezoelectric sensor 4 is installed at the lower portion of the thin pad P as shown in FIG. 2. This piezoelectric sensor detects the fact that the pad has turned ON (has been struck) and the strength of the strike against the pad. Speakers 5 which generate played and ABC tones are located at the left and right sides of the electronic percussion instrument body 1.

In the electronic percussion instrument body 1, when the percussion set name is set to the ABC mode by the percussion set switch 23, if the time between the first and second time each pad turns ON is within the specified time, chord data corresponding to that pad, i.e., root data and chord type data, are generated. Furthermore, when the percussion set name is set to a mode other than the ABC mode, tone colors corresponding to that set name are set to each pad, or the tone colors and scale tones corresponding to the set name corresponding to the set name can be set to each pad. The function of the foot pedal 3 changes according to the percussion set name.

FIG. 3 shows the function of each pad and the foot pedal 3 corresponding to the percussion set name specified by the percussion set switch 23. For example, when the percussion set name "rock drums" has been specified, the snare drum tone color is set to the pad P2, the cymbal 1 tone color is set to the pad P7, and depression of the foot pedal 3 indicates the generation of the musical tone of the bass drum tone color. When the percussion set name is set to "rock drums", "jazz drums", or "synthesizer drums", the tone color of each pad P1 to P8 will be set. When the percussion set name is set to "timpani", "marimba", or "vibraphone", however, the tone pitches must be set to P1 to P8. Furthermore, the tone pitches set to each pad must be set so that their scales are ordered P1/P5, P2/P6, P3/P7, P4/P8. When so ordered, timpani, marimba, and vibraphone tone colors will be set when each of these percussion set names are respectively set. The percussion set names "rock drums", "jazz drums", and "synthesizer drums" are set names for a drum tone group, while "timpani", "marimba", and "vibraphone", are set names for a scale tone group.

When the percussion set name is set to the ABC mode, root and chord type data are assigned to each pad. For example, root data "C" and chord type data "Maj" are assigned to the pad P1 in the ABC mode referring to FIG. 3. In other words, in the ABC mode, when P1 turns ON once, and then turns ON a second time within the specified time, the ABC playing (auto accompaniment) is executed according to the root "C" and the chord type "Maj". In the ABC mode, the foot pedal 3 is used to raise the pitch of tones output from the speakers 5 by a halftone. Thus, for example, if the pad P1 turns ON (is struck) a second time within the specified time while the foot pedal 3 is being depressed in the ABC mode, the ABC playing will be played according to a "C#/Maj" chord.

FIG. 3 shows only an example of the percussion set names which can be set in the electronic percussion instrument body 1 of an embodiment according to the present invention. In reality, however, numerous set names can be set.

Figure 4:
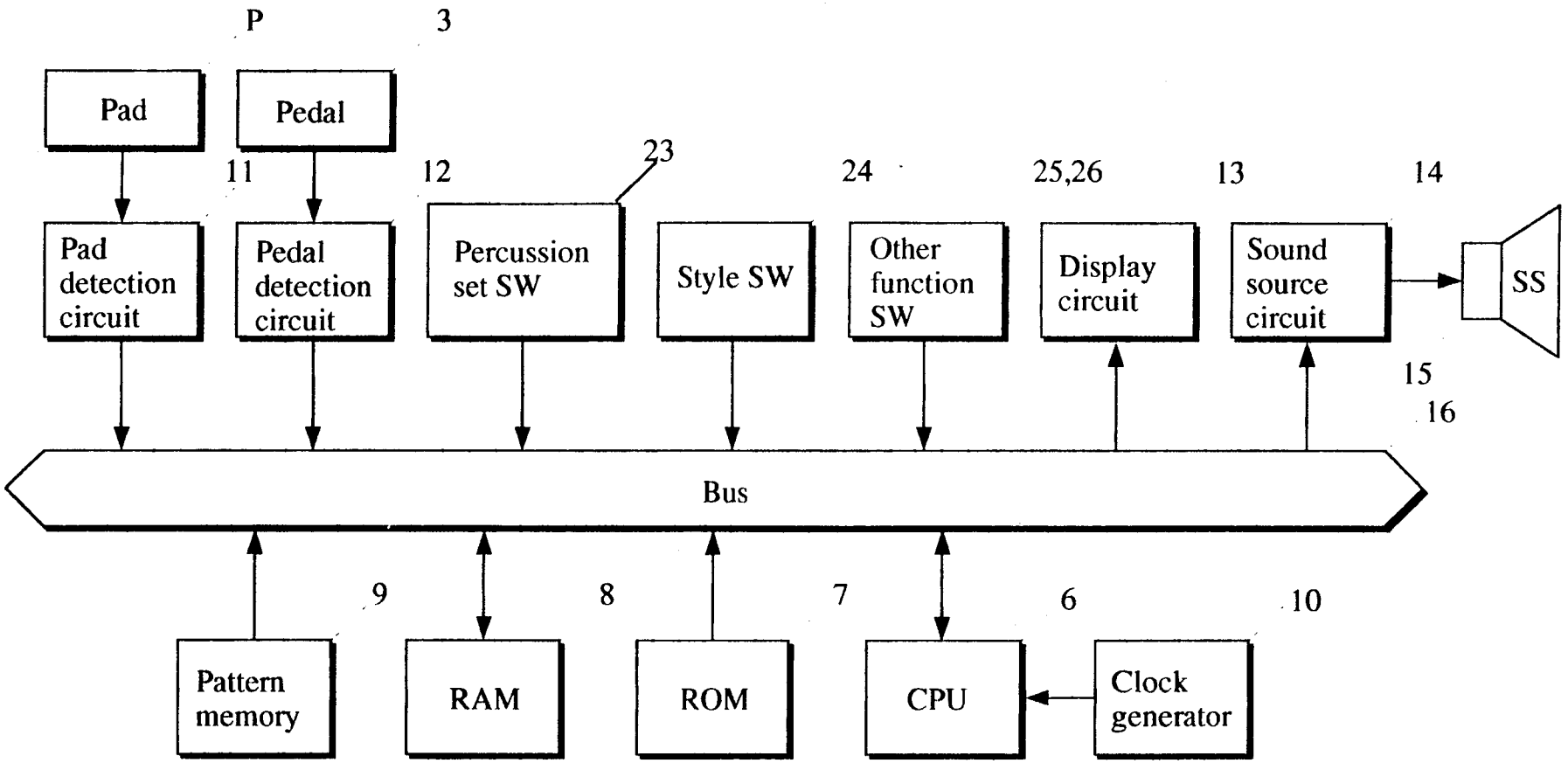
FIG. 4 shows the configuration of the above electronic percussion instrument.

FIG. 4 shows the configuration of the electronic percussion instrument body 1 of an embodiment according to the present invention.

A control section consists of a CPU 6, a ROM 7, a RAM 8, a pattern memory 9, and a clock generator 10 which sends interrupt signals to the CPU 6. A pad detection circuit 11, a pedal detection circuit 12, a percussion set switch 23, a style switch 24, a ten-key 25, and a functions switch 26 shown in FIG. 1, a display circuit 13 with LCD indicators 22, and a sound source circuit 14 are all connected to the control section via a control bus 16, and a sound system 15 is connected to the sound source circuit 14. The above-mentioned pattern memory 9 stores chord generation patterns in the ABC mode. The pad detection circuit 11 which includes the piezoelectric sensor 4 (FIG. 2) installed at the lower portion of each pad detects a pad ON condition and each pad's touch data. The pedal detection circuit 12 detects an ON condition (depressed condition) of the foot pedal 3. The sound source circuit 14 receives playing data consisting of tone color data of tones generated from the CPU 6, pad touch data, and chord data, as well as note ON signal. It then generates musical tone signals from this data and outputs them to the sound system 15. When the sound system 15 inputs these musical tone signals, it outputs musical tones from the speakers 5.

The pattern memory 9 stores chord generation patterns which are read by the CPU 6 in the ABC mode. The clock generator 10 divides each bar into 96 based on a tempo set by a tempo setting switch not shown in the figure, and sends interrupt signals to the CPU 6 at each divided timing. As will be explained later, the CPU 6 outputs chord data and octave data to the sound source 14 when a clock interrupt occurs.

FIG. 5 shows data registers assigned to the RAM 8. Hereafter, the content of the flow charts in FIG. 6 executed by the CPU 6 shall be explained while referring to FIG. 5.

Figure 6:
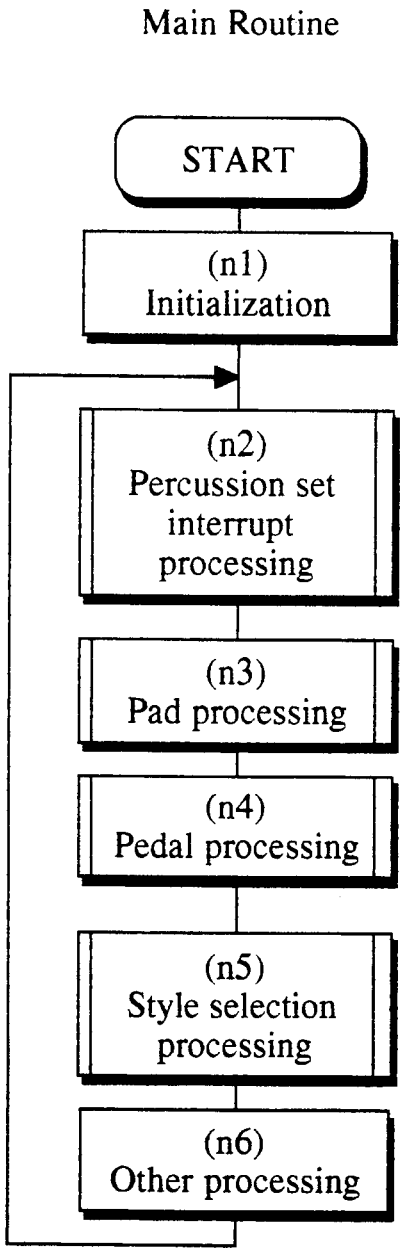
FIGS. 6 to 12 are flow charts showing CPU operations.

(1) Main Routine (FIG. 6)

In step n1, when the CPU 6 is initially reset, such as when the power supply is turned ON, the data registers are also reset. The following subroutines are then executed in steps n2 to n5: percussion set interrupt processing, pad processing, pedal processing, and style selection processing. In step n6, volume data specified by the displays and volume 21 of each data type are read and tempo data set by a tempo switch in the functions switch 26 is read.

Figure 7:
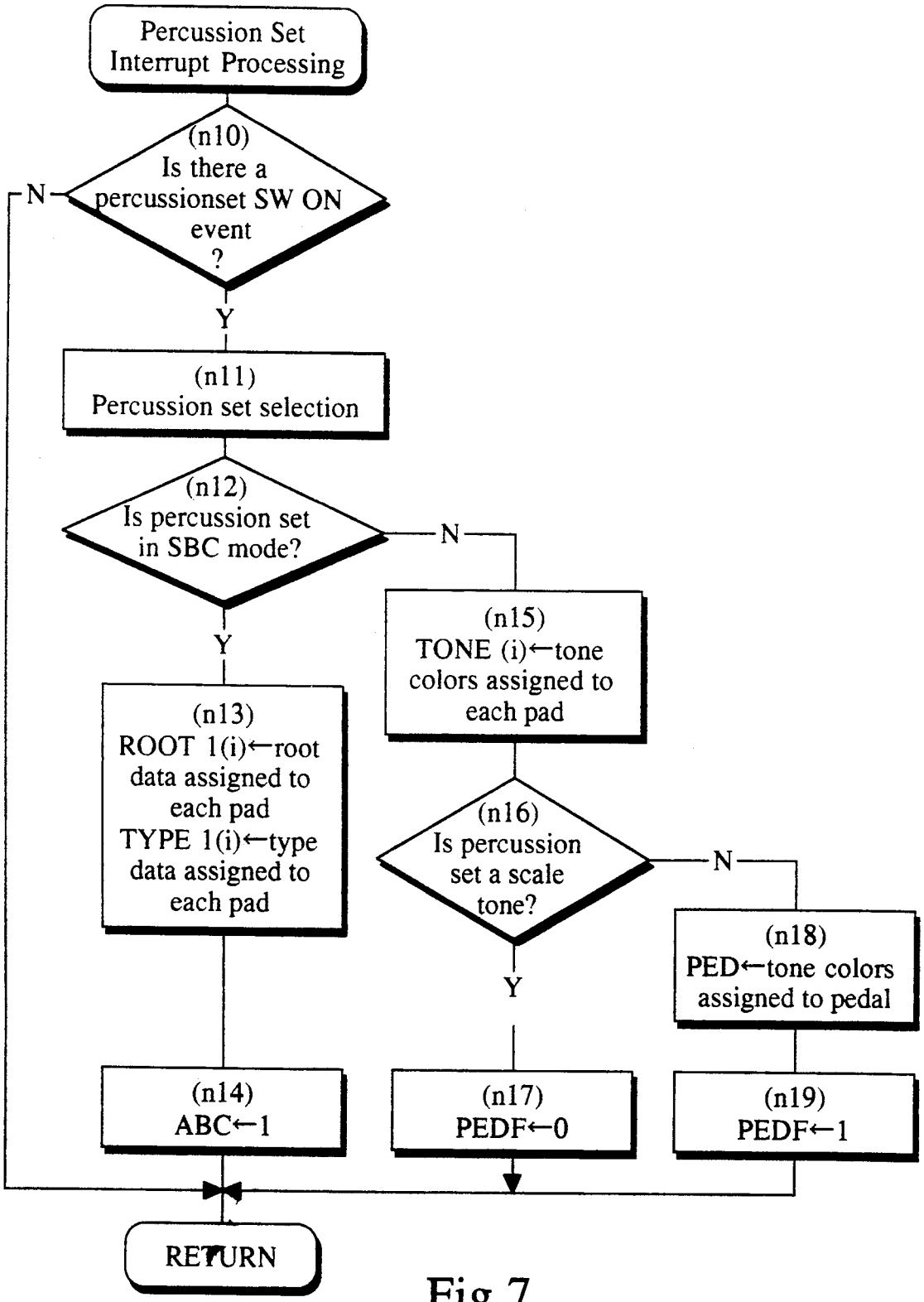

(2) Percussion Set Interrupt Processing (FIG. 7)

In this percussion set interrupt processing, a set condition of the percussion set switch 23 is read, data corresponding to each register and flag is assigned, and ON/-OFF settings are executed.

First, whether or not a percussion set switch 23 is ON event is judged in step n10. If ON, i.e., if there is a percussion set switch operation, the percussion set name is selected by ten-key input in step n11. Referring to FIG. 3, depressing "1" on the ten-key 25, for example, selects the percussion set name "rock drums". Depressing "7" selects the "auto bass chord (ABC)".

In step n12, whether or not the percussion set name has been set to the ABC mode is judged. If YES, the root tone data assigned to the pads P1 to P8 is set to a register ROOT 1 (i). "i" indicates a pad no. register for P1 to P8. Step n13 is repeated from i=1 to 8. Thus, "C" data is set to the ROOT 1 (1) register; "E" to the ROOT 1 (2), and "C" to the ROOT 1 (8). Also in step n13, as shown in FIG. 3, chord type data assigned to each pad is set to a register TYPE 1 (i). Thus, major (Maj) is set to the TYPE 1 (1); major seven (M7) to the TYPE 1 (2), and diminish (dim) to the TYPE 1 (8).

When the above processing is completed, an auto bass chord flag ABC is set in step n14.

When a percussion set name other than the ABC mode is selected in step n11 above, processing moves from step n12 to step n15. In step n15, tone color data assigned to pads P1 to P8 is set to a pad tone color register TONE (i). If, for example, "rock drums" is selected for the percussion set name, "synthesizer snare" data will be set to the TONE (i) and "cymbal 2" data set to the TONE (8). When one of the scale tone group such as "timpani", "marimba", etc. is selected as the percussion set name, the data for the selected scale tone group will be stored in the register TONE (1) to TONE (8). Whether or not a percussion set name from the scale tone group has been selected is judged in step n16. If YES, a pedal flag PEDF is reset in step n17. If NO, i.e., if a one of the drum tone group has been selected, tone color data assigned to the foot pedal 3 is set to a pedal tone color register PED in step n18. As shown in FIG. 3, when the percussion set name is one of the drum tones "rock drums", "jazz drums", or "synthesizer drums", all tone color data set to the PED register is bass drum data. When step n18 is completed, the PEDF flag is set in step n19 and processing returns to the main routine.

Figure 8:
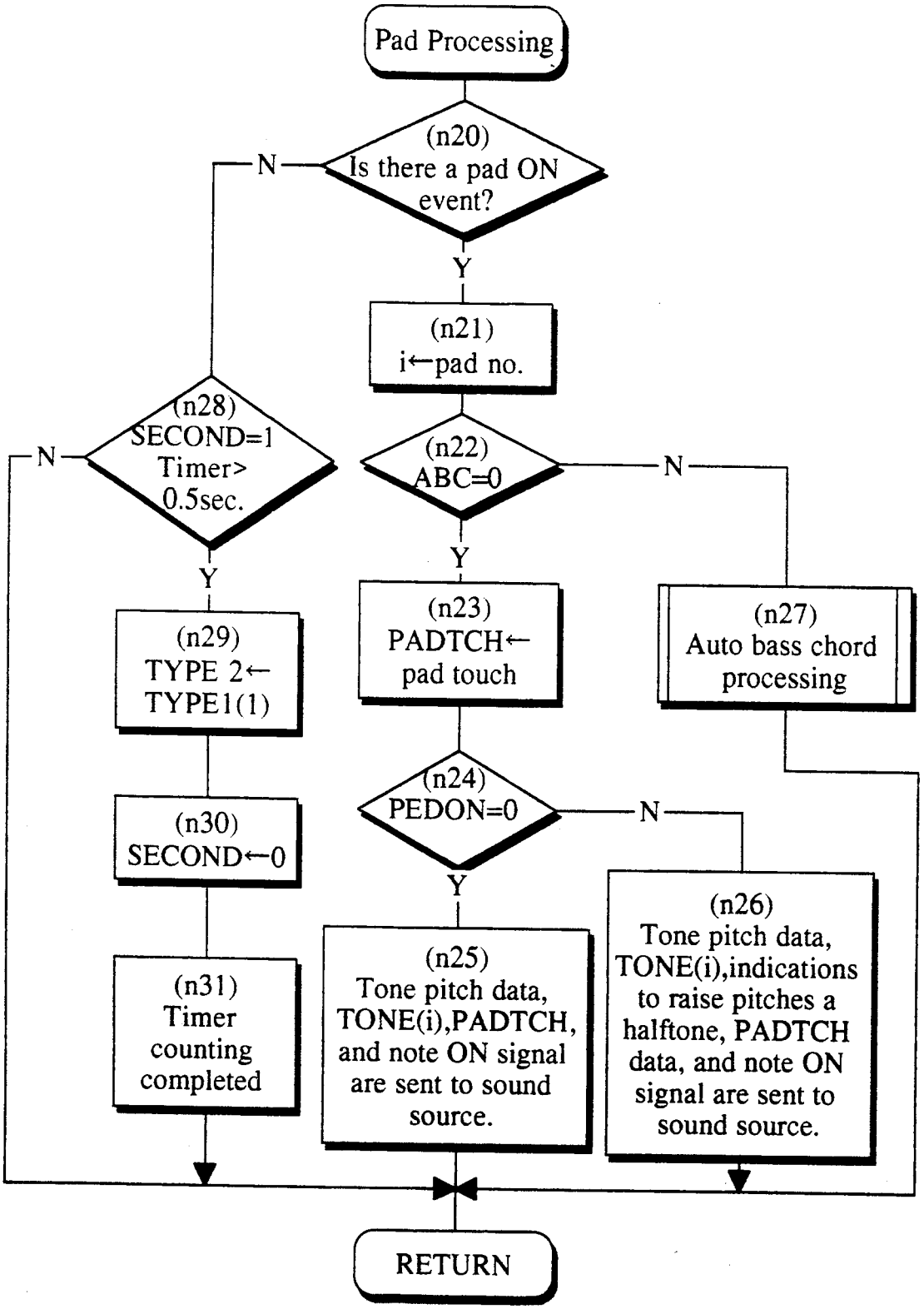

(3) Pad Processing (FIG. 8)

First, whether or not there is a pad ON event (a pad is turned ON) is judged in step n20. When a pad ON event is generated by a pad strike, the number of the ON pad is set to the register i in step n21. Next, the condition of the ABC flag is judged in step n22. If this flag has been reset, pad touch data is set to a pad touch register PADTCH in step n23. This pad touch data is output from the pad detection circuit 11 containing the piezoelectric sensor 4. Next, the condition of a pedal ON flag PEDON is judged in step n24. If this flag has been reset, data set to the TONE (i) and the PADTCH, tone pitch data indicating the tone pitch assigned to a pad number indicated by the register i (refer to FIG. 3), and a note ON signal are sent to the sound source circuit 14 in step n25. When the sound source circuit 14 receives these signals, it generates specified musical tone signals and outputs them to the sound system 15. Furthermore, if the PEDON flag in step n24 is set, tone pitch data showing the tone pitch (refer to FIG. 3) assigned to a pad number indicated by the register i, data set to the TONE (i) and the PADTCH, data indicating that a pitch of the musical tone signals are to be raised by a halftone, and note ON signal are sent to the sound source circuit 14. When the flag PEDON turns ON, the selected percussion set name is one of the scale tone group or the ABC mode and when the foot pedal 3 is depressed. Thus, when the percussion set name is set to one of the scale tone group when the foot pedal 3 is depressed, processing proceeds from step n24 to n26, and both the pad tone pitch data set to the TONE (i) and data indicating that the musical tone signals are to be raised a halftone are output.

When the flag ABC in step n22 is set, however, processing moves to the auto bass chord subroutine processing in step n27.

In the main routine in FIG. 6, if there is no pad ON event when the pad processing subroutine of step n3 begins, processing moves to steps n20 and n28. In step n28, a second ON flag SECOND is set and whether or not lapse of time exceeds 0.5 sec is judged This SECOND flag is set when any pad P1 to P8 turns ON for the first time in the ABC mode. The timer starts counting when the SECOND flag is set. When the conditions in step n28 are not satisfied, processing returns to the main routine. Meeting conditions in step n28 means that a second pad operation did not occur within 0.5 sec from the first pad-ON in the ABC mode. When affirmative judgment occurs in n28, processing moves to step n29 in which a chord consisting of a root of a pad which turned ON once and a previously determined specified chord type is prepared to be output as a musical tone. In other words, chord type data set to the TYPE (1) moves to the TYPE 2 and root data set to the ROOT 4 moves to the ROOT 2. The TYPE 2 and ROOT 2 are used to generate final chord data. When the percussion set switch 23 is operated, chord type data assigned to the P1 is stored to the TYPE I(1) in step n13 of FIG. 7. Furthermore, when any pad Pl to P8 turns ON for the first time, root data assigned to that pad is temporarily stored in the ROOT 4. Thus, chord type data set to the TYPE 1(1) in step n29 is used as specified chord type data and root data set to the ROOT 4 is used as the root data. When the above processing is completed, the flag SECOND is reset, namely, it returns to its initial condition in step n30. The timer is reset in step n31.

Figure 9:
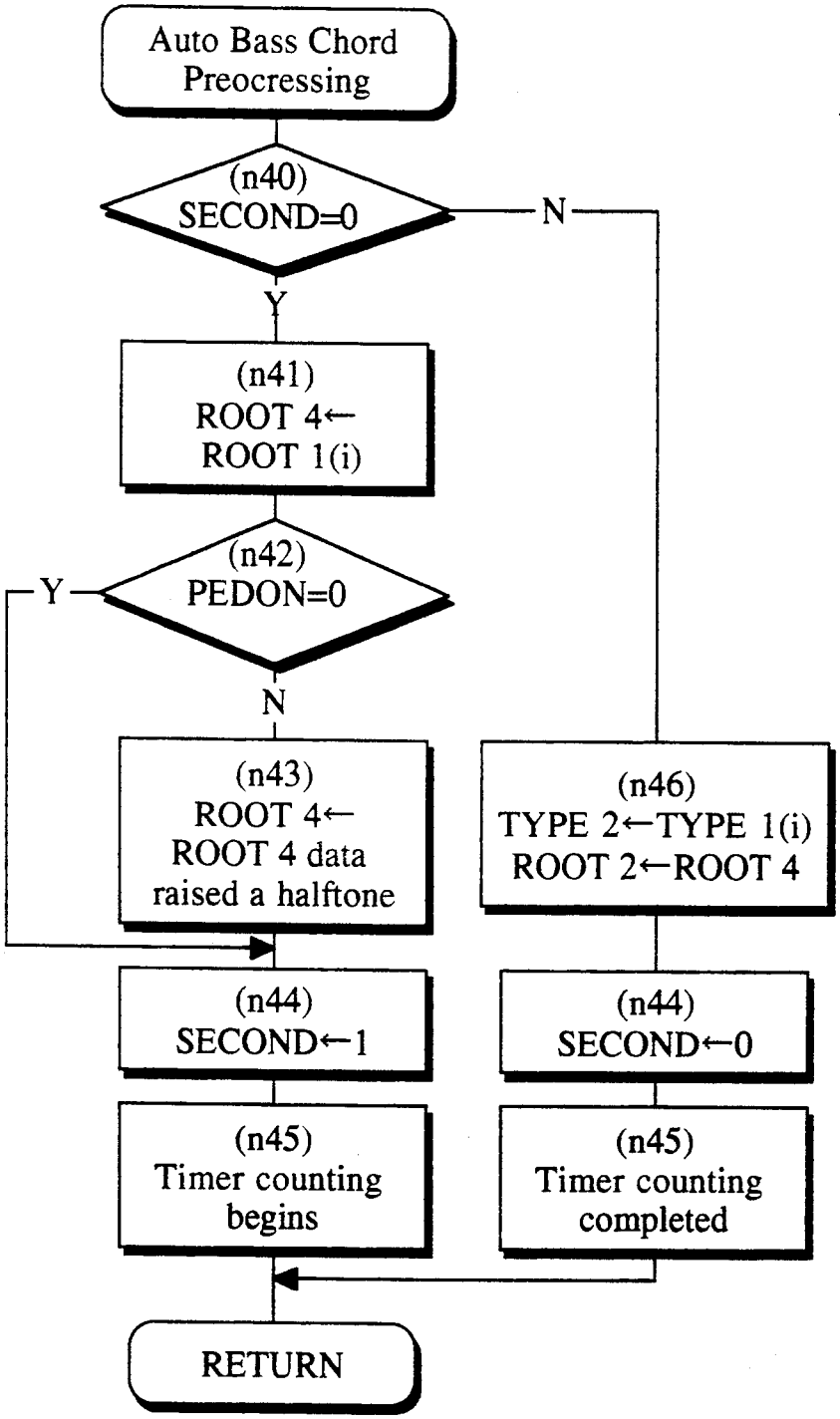

(4) Auto Bass Chord Processing (FIG. 9)

Auto bass chord processing is a subroutine executed in the pad processing subroutine of step n27 in FIG. 8.

The condition of the flag SECOND is judged in step n40. If this flag has been reset, a pad in the ABC mode has turned ON for the first time, at which time, data set to the ROOT I (i) is moved to the ROOT 4 used as a buffer register.

Pad no. data set in step n21 of FIG. 8 is stored in the register i. Root data assigned to each pad in step n13 of FIG. 7 is set to the ROOT I (i). Thus, root data corresponding to a pad which is judged to be ON event is set to the ROOT 4 in step n41. Next, the condition of the flag PEDON is judged in step n42. Since ABC playing signals are raised a halftone when the foot pedal 3 is depressed in the ABC mode, processing moves from step n42 to step n43, in which root data set to the ROOT 4 is converted to data a halftone higher and set once again to the ROOT 4. In step n44, the flag SECOND is set, and in step n45, the timer starts.

Once the above ABC processing is completed, if a pad turns ON a second time within 0.5 sec, processing again returns to the ABC processing subroutine. When this occurs, since the flag SECOND has been set, processing moves to steps n40 to n46. In step n46, data set to the TYPE 1 (i) moves to the TYPE 2 and data set to the ROOT 4 moves to the ROOT 2. At this point, chord type and root data for generating a chord are set to the TYPE 2 and the ROOT 2, respectively. In step n47, the flag SECOND is reset and the timer is reset in step n48. Processing then returns.

Figure 10:
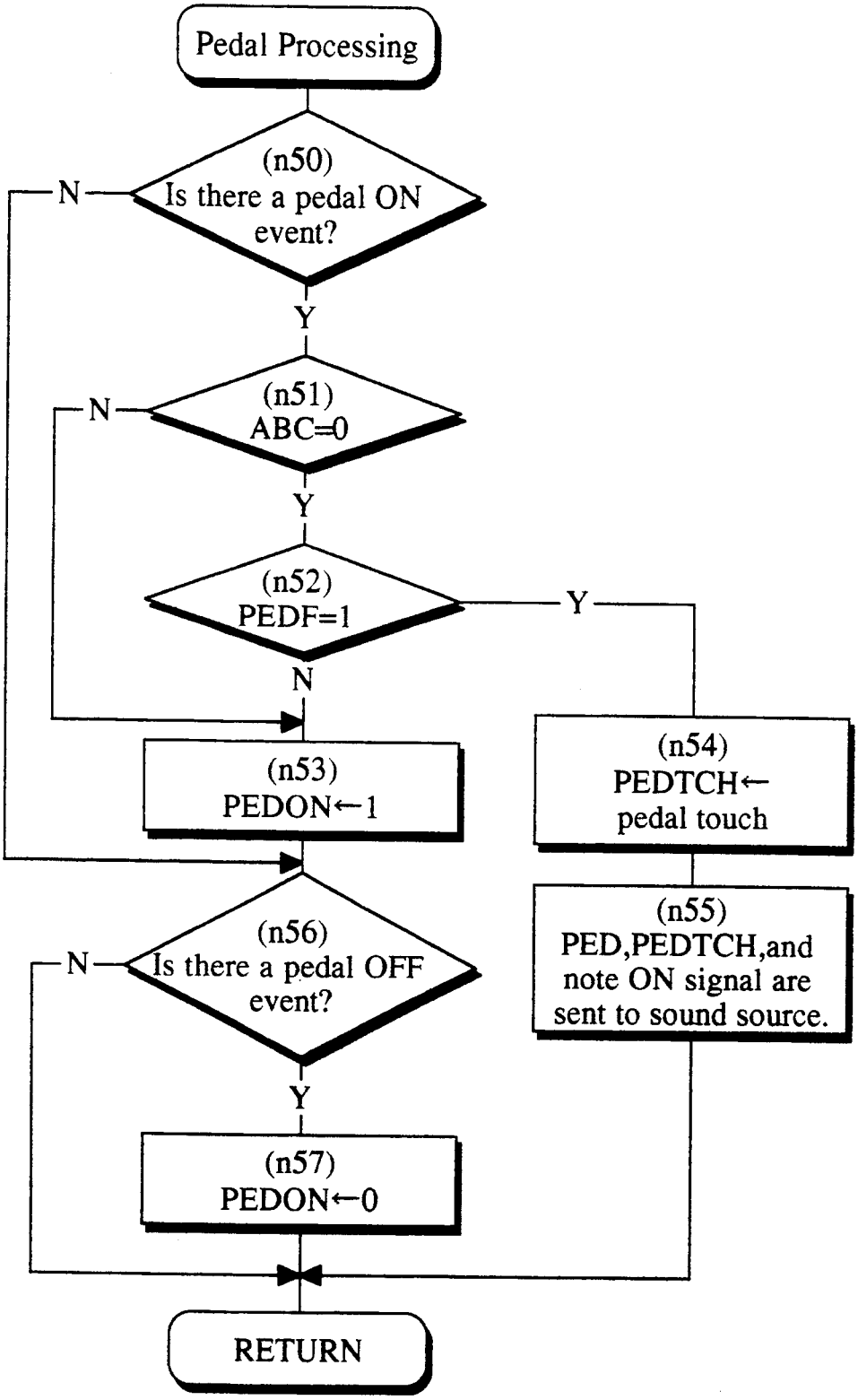

(5) Pedal Processing Subroutine (FIG. 10)

Whether or not there is a pedal ON event is judged in step n50. When the foot pedal 3 is depressed (there is a pedal 0N event), the conditions of the flags ABC and PEDF are judged in steps n51 and n52, respectively. When the flag ABC is set or when the flags ABC and PEDF are reset, processing moves to step n5 in which the PEDON flag is set. If the flag ABC has been reset and the flag PEDF has been set, processing moves to step n54. In step n54, since bass drum tones must be output when the foot pedal 3 is depressed in the drum tone mode, pedal touch data is fetched from the pedal detection circuit 12 and this data is set to the PADTCH. When this processing is completed, data set to the PED in step n18 of FIG. 7, data set to the PEDTCH, and a note ON signal are sent to the sound source circuit 14 in step n55. In step n55, if bass drum data has been set to the PED, bass drum musical tones will be output from the speakers 5. Furthermore, the bass drum volume will be determined by the depth to which the foot pedal 3 is depressed.

If there is a foot pedal 3 OFF event, processing moves to step n56, then to step n57 in which the flag PEDON is reset.

The pedal processing subroutine is executed as described above. When a percussion set name is selected from the scale tone group shown in FIG. 3, or when the ABC mode is selected, the flag PEDO is set and reset according to the ON/OFF condition of the foot pedal 3 in this subroutine. As described above, the set condition of the PEDON flag is referred in step n24 of FIG. 8 and step n42 of FIG. 9 explained above.

Figure 11:
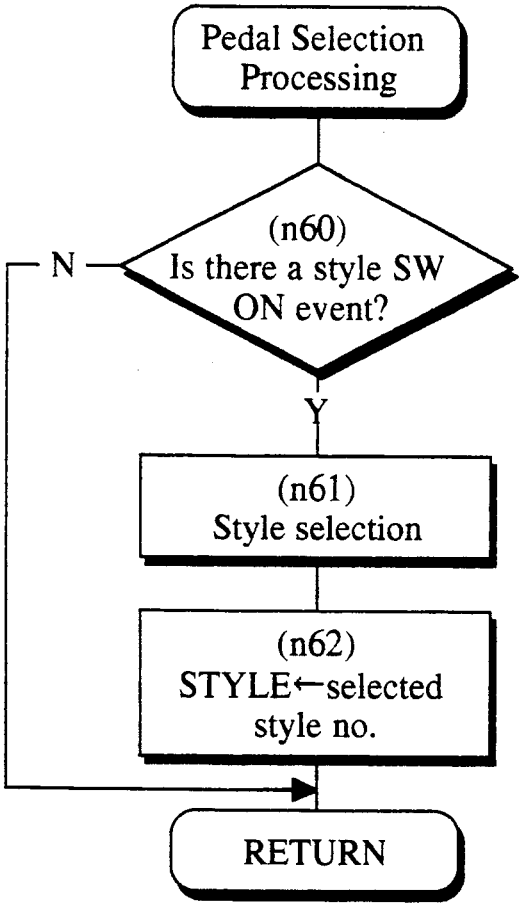

(6) Style Selection Processing (FIG. 11)

Style selection processing is a subroutine executed in step n5 of the main routine.

First, whether or not there is a style switch ON event is judged in step n60. If this switch is ON, processing moves to step n61 in which style data is set. Style means chord generation pattern when in the ABC mode. Each style has been previously stored in the pattern memory 9. To select and set a style, the player first turns the style switch ON, and then inputs the number corresponding to the desired style using the ten-key 25 in step n61. Next, the style number selected by the player is set to a style no. register STYLE in step n62.

Figure 12:
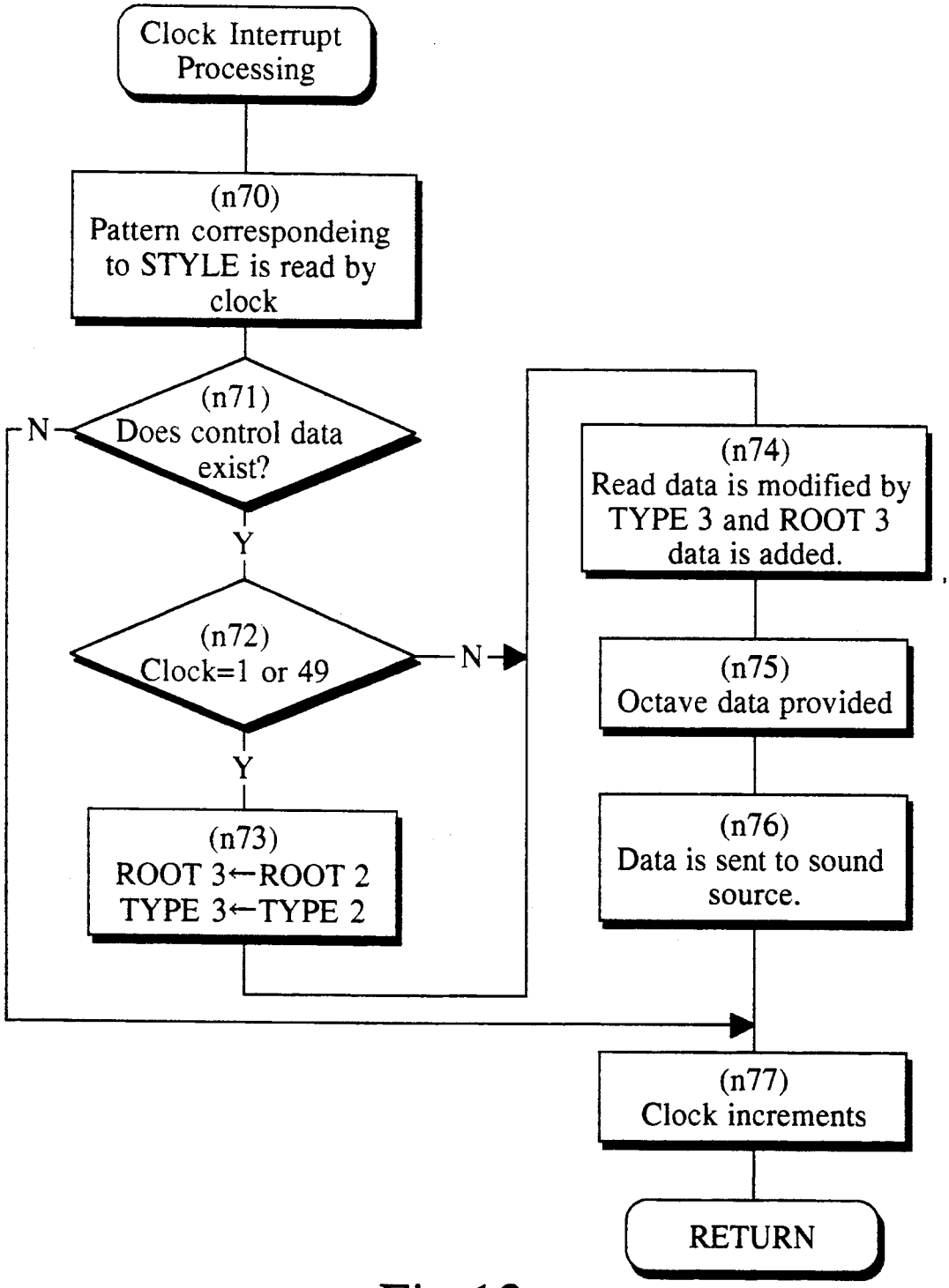

(7) Clock Interrupt Processing (FIG. 12)

Clock interrupt processing is a subroutine executed when clock signal (tempo clock signal) is sent to the CPU 6 by the clock generator 10.

As was explained previously, the tempo of accompaniment (ABC tones) output in the ABC mode is set by the tempo switch in the functions switch 26. The clock generator 10 divides 1 bar into 96 based on the set tempo and outputs a tempo clock. First, in step n70, data equivalent to one clock of the chord generation pattern corresponding to the style no. data set to the STYLE register is read. Chord generation pattern data stored in the pattern memory 9 shall be specified standard root data and "Maj" chord type data.

Next, whether or not control data is among the read data is judged in step n71. Since the timing should be generated when the control data exists, processing moves to step n72. In this step, whether read data has been read by 1st clock in a bar, or by the clock at 1 bar's intermediate position, i.e., at the 49th clock, is judged. If "yes" is judged, data set to the ROOT 2 moves to the ROOT 3, and data set to the TYPE 2 moves to the TYPE 3 in step n73. Root tone and chord type data are set to the ROOT 2 and the TYPE 2 in step n29 of FIG. 8 and step n46 of FIG. 9. In step n74, read data is modified by data set to the TYPE 3 in the above step n73, and data set to the ROOT 3 is added to the read data. As shown above, in chord generation pattern data stored in the pattern memory 9, since standard root data serves as the root data and "Maj" as the chord type data, the modification in step n74 is executed to generate the actual data. In other words, the data read in step n70 is modified to fit the actual chord type. Furthermore, only root data set to the ROOT 3 is added to the modified read data, and the data for each chord is created. In step n75, octave data is provided. This is due to the fact that since tone colors in chord generation pattern data stored in the pattern memory 9 are different according to style, octave data appropriate to the tone color must be set at this stage. In step n76, the above data is sent to the sound source circuit 14. The clock is incremented by one in step n77 and processing returns. The clock increments from 1 to 96, and then returns to 1 again.

In the above operations, then, if the time interval between the 1st and 2nd a pad ON is less than 0.5 sec, chord data consisting of root and chord type data corresponding to each pad can be generated and generated as musical tone signals. Furthermore, when the time between the 1st and 2nd a pad ON exceeds 0.5 sec, chord data including the specified chord type data can be generated.

When the clock in step n72 above is counted up to 49, processing once again moves to step n73 in which the contents of the ROOT 3 and TYPE 3 are renewed by data set to the ROOT 2 and TYPE 2. When the clock is counted otherwise, this content is not renewed. In this way, then, when a new chord is specified by another pad at any timing of a half bar, once the half bar is passed, new chord data can be generated. In other words, since the chord generation pattern is changed with a half bar as the minimum unit, it is not difficult to hear, at whatever timing chord pad processing for chord changing is executed.

Although the timing of chord generation pattern changing above is at the beginning and in the middle of a bar, it is not limited as such. Although the present invention applies to electronic percussion instruments equipped only with pads, it is possible to apply it to other electronic musical instruments in which pads have been installed. Furthermore while the auto bass chord can be changed in the electronic percussion instrument embodying the present invention, it is possible to change other chords as well. Also, playing in real time while generating the auto bass chord in the electronic percussion instrument embodying the present invention is possible as is use of the present invention when using sequencer step input.

In this example, monitoring interval time between the same pad operations is 0.5 second. It is possible that this interval time varies according to playing music tempo.

As shown above, since specified chords can be generated by the player, real time playing can be generated and electronic percussion playing can be performed as accompaniment according to previously stored chords. Furthermore, since pads are used for chord specification, special switches are unnecessary. Also, since a variety of chord data can be generated by a plurality of pads, the generation of monophonic musical tones from these chords can be prevented.

What is claimed is:

1. An electronic musical instrument comprising:

a plurality of pads, each capable of being manually operated by a player of the electronic musical instrument;

pad operation detection means for detecting operation of each of the plurality of pads;

measurement means for measuring a time interval between two pad operations of the plurality of pads in response to detection of pad operation by the pad operation detection means;

chord data generation means for generating specified chord data corresponding to a pad of the plurality of pads whose operation has been detected by the pad operation detection means when a time interval measured by the measurement means is within a specified time, the chord data being assigned to the pad and including root data and type data; and accompaniment playing means for performing accompaniment playing corresponding to the chord data generated by the chord data generation means.

2. An electronic musical instrument comprising:

a plurality of pads, each capable of being manually operated by a player of the electronic musical instrument;

pad operation detection means for detecting operation of each of the plurality of pads;

measurement means for measuring a time interval between two pad operations of the plurality of pads in response to detection of pad operation by the pad operation detection means;

chord data generation means for generating specified chord data corresponding to a pad of the plurality of pads whose operation has been detected by the pad operation detection means when a time interval measured by the measurement means is within a specified time; and accompaniment playing means for performing accompaniment playing corresponding to the chord data generated by the chord data generation means;

said chord data generation means generating chord data consisting of previously determined chord type data and root data when a time interval measured by the measurement means exceeds said specified time, the root data corresponding to a pad of the plurality of pads which is first operated.

3. An electronic musical instrument comprising:

a plurality of pads, each capable of being manually operated by a player of the electronic musical instrument;

pad operation detection means for detecting operation of each of the plurality of pads;

measurement means for measuring a time interval between two pad operations of the plurality of pads in response to detection of pad operation by the pad operation detection means;

chord data generation means for generating specified chord data corresponding to a pad of the plurality of pads whose operation has been detected by the pad operation detection means when a time interval measured by the measurement means is within a specified time; and accompaniment playing means for performing accompaniment playing corresponding to the chord data generated by the chord data generation means;

said chord data generation means generating root data based on the first pad operation and type data based on the second pad operation.

4. The electronic musical instrument according to claim 1, further comprising designating means for providing a halftone raise of said chord data.

5. The electronic musical instrument according to claim 4, wherein said designating means includes a foot pedal.

6. The electronic musical instrument according to claim 3, further comprising designating means for providing a halftone raise of said chord data, said plurality of pads consists of eight pads, and said chord data generation means generates root data based on operation of a pad of the plurality of pads and on the designating means.

7. An electronic musical instrument comprising:

a plurality of pads, each capable of being manually operated by a player of the electronic musical instrument;

pad operation detection means for detecting operation of each of the plurality of pads;

measurement means for measuring a time interval between two pad operations of the plurality of pads in response to detection of pad operation by the pad operation detection means;

chord data generation means for generating specified chord data corresponding to a pad of the plurality of pads whose operation has been detected by the pad operation detection means when a time interval measured by the measurement means is within a specified time;

accompaniment playing means for performing accompaniment playing corresponding to the chord data generated by the chord data generation means; and memory means for previously storing chord data corresponding to each pad, the chord data being read out in response to detection of pad operation by the pad operation detection means.

8. The electronic musical instrument according to claim 7, further comprising means for editing chord data stored in said memory means.

9. The electronic musical instrument according to claim 1, further comprising:

tempo specifying means for specifying tempo; and tempo generating means for generating a tempo clock according to the specified tempo, wherein, when new chord data is generated by the chord data generation means during the performance of accompaniment playing corresponding to previously generated chord data, said accompaniment playing means continues accompaniment playing corresponding to the previous generated chord data to a specified timing of one bar based on the tempo clock, at which specified timing accompaniment playing corresponding to the new chord data is performed.

10. An electronic percussion musical instrument comprising:

a plurality of pads, each capable of being manually operated by a player of the electronic percussion musical instrument;

pad operation detection means for detecting operation of each of the plurality of pads;

percussion designating means for selecting a function to be assigned to each of the plurality of pads from tone color, scale tone, or accompaniment percussion set names;

measurement means for measuring a time interval between two operations of the same pad of the plurality of pads in response to detection of pad operation by the pad operation detection means;

chord data generation means for generating specified chord data corresponding to a pad of the plurality of pads whose operation has been detected by the pad operation detection means when a time interval measured by the measurement means is within a specified time, the chord data being assigned to the pad and including root data and type data;

musical tone output means for outputting a musical tone of a tone color or a scale tone corresponding to a pad of the plurality of pads which has been operated at the selection of the tone color or scale tone percussion set name by the percussion designating means; and accompaniment playing means for performing accompaniment playing corresponding to chord data when the chord data is generated at the selection of the accompaniment percussion set name by the percussion designating means.

11. The electronic percussion musical instrument according to claim 10, wherein said chord data generation means generates root data based on the first pad operation and type data based on the second pad operation.

* * * * *